US008151882B2

(12) United States Patent
Grigar et al.

(10) Patent No.: US 8,151,882 B2
(45) Date of Patent: Apr. 10, 2012

(54) TECHNIQUE AND APPARATUS TO DEPLOY A PERFORATING GUN AND SAND SCREEN IN A WELL

(75) Inventors: Larry L. Grigar, East Bernard, TX (US); Joe C. Hromas, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 209 days.

(21) Appl. No.: 11/162,216

(22) Filed: Sep. 1, 2005

(65) Prior Publication Data

US 2007/0044964 A1 Mar. 1, 2007

(51) Int. Cl.
*E21B 43/00* (2006.01)

(52) U.S. Cl. ..... 166/278; 166/298

(58) Field of Classification Search ..... 166/278, 166/298, 51

See application file for complete search history.

(56) References Cited

U.S. PATENT DOCUMENTS

| | | | | |
|---|---|---|---|---|
| 3,482,219 | A | 12/1969 | Gratian | |
| 3,863,718 | A | 2/1975 | Bruist | |
| 4,372,384 | A | 2/1983 | Kinney | |
| 4,547,298 | A | 10/1985 | Novak | |
| 4,627,496 | A | 12/1986 | Ashford et al. | |
| 5,165,478 | A | 11/1992 | Wilson | |
| 5,224,556 | A | 7/1993 | Wilson | |
| 5,228,518 | A | 7/1993 | Wilson | |
| 5,346,016 | A | 9/1994 | Wilson | |
| 5,379,838 | A | 1/1995 | Wilson et al. | |
| 5,445,228 | A | 8/1995 | Rathmell et al. | |
| 5,467,823 | A | 11/1995 | Babour | |
| 5,494,107 | A | 2/1996 | Bode | |
| 5,660,232 | A | 8/1997 | Reinhardt | |
| 5,829,538 | A | 11/1998 | Wesson et al. | |
| 5,881,814 | A | 3/1999 | Mills | |
| 5,890,538 | A | 4/1999 | Beirute et al. | |
| 5,971,072 | A | 10/1999 | Huber | |
| 6,009,947 | A | 1/2000 | Wilson | |
| 6,302,203 | B1 | 10/2001 | Rayssiguier | |
| 6,386,288 | B1 | 5/2002 | Snider | |
| 6,494,261 | B1 * | 12/2002 | Pahmiyer | 166/281 |
| 6,536,524 | B1 | 3/2003 | Snider | |
| 6,557,636 | B2 | 5/2003 | Cernocky et al. | |
| 6,575,245 | B2 | 6/2003 | Hurst | |
| 6,584,406 | B1 | 6/2003 | Harmon et al. | |
| 6,695,054 | B2 | 2/2004 | Johnson | |
| 6,848,510 | B2 | 2/2005 | Bixenman | |
| 6,885,918 | B2 | 4/2005 | Harmon et al. | |
| 6,962,202 | B2 * | 11/2005 | Bell et al. | 166/297 |
| 7,131,494 | B2 | 11/2006 | Bixenman | |
| 7,152,676 | B2 | 12/2006 | Vella et al. | |

(Continued)

FOREIGN PATENT DOCUMENTS

| | | |
|---|---|---|
| EP | 0288237 | 10/1988 |

(Continued)

*Primary Examiner* — William P Neuder
(74) *Attorney, Agent, or Firm* — Chadwick A. Sullivan; Rodney Warfford

(57) ABSTRACT

A system that is usable with a well includes tubular body, at least one perforating charge that is disposed on the tubular body and at least one screen section that is disposed on the tubular body. The perforating charge(s) and the screen sectional(s) are adapted to be run downhole in a single trip into the well with the tubular body.

22 Claims, 5 Drawing Sheets

U.S. PATENT DOCUMENTS

| | | | | |
|---|---|---|---|---|
| 7,278,484 | B2 | 10/2007 | Vella et al. | |
| 2001/0027864 | A1 | 10/2001 | Vahnshteyn | |
| 2001/0045281 | A1 | 11/2001 | Foster | |
| 2002/0020535 | A1 | 2/2002 | Johnson | |
| 2002/0088620 | A1 | 7/2002 | Lerche et al. | |
| 2002/0092649 | A1 | 7/2002 | Bixenman | |
| 2002/0125011 | A1 | 9/2002 | Snider et al. | |
| 2002/0157829 | A1 * | 10/2002 | Davis et al. | 166/297 |
| 2003/0000411 | A1 | 1/2003 | Cernocky et al. | |
| 2003/0001753 | A1 | 1/2003 | Cernocky et al. | |
| 2003/0098157 | A1 | 5/2003 | Hales et al. | |
| 2003/0106697 | A1 | 6/2003 | Bode | |
| 2003/0230406 | A1 | 12/2003 | Lund | |
| 2004/0107825 | A1 | 6/2004 | Kash | |
| 2004/0129419 | A1 * | 7/2004 | Van Wulfften Palthe | 166/278 |
| 2004/0159432 | A1 * | 8/2004 | Johnson et al. | 166/297 |
| 2004/0188093 | A1 * | 9/2004 | Funchess | 166/299 |
| 2004/0251024 | A1 * | 12/2004 | Jones | 166/278 |
| 2004/0251033 | A1 | 12/2004 | Cameron et al. | |
| 2005/0109508 | A1 * | 5/2005 | Vella et al. | 166/297 |
| 2005/0178554 | A1 | 8/2005 | Hromas et al. | |
| 2005/0263286 | A1 * | 12/2005 | Sheffield | 166/297 |

FOREIGN PATENT DOCUMENTS

| | | | |
|---|---|---|---|
| EP | 0628699 | | 12/1993 |
| GB | 2296924 | B | 4/1997 |
| GB | 2296925 | B | 4/1997 |
| GB | 2297107 | B | 4/1997 |
| GB | 2352261 | | 1/2001 |
| GB | 2397594 | A | 7/2004 |
| GB | 2395962 | A | 9/2004 |
| WO | WO-95/09965 | A1 | 4/1995 |
| WO | WO-95/09966 | A1 | 4/1995 |
| WO | WO-95/-09967 | A1 | 4/1995 |
| WO | WO-95/-09968 | A1 | 4/1995 |
| WO | WO-95/-17577 | A1 | 6/1995 |
| WO | WO-00/65195 | | 11/2000 |
| WO | WO 03/002849 | | 1/2003 |

* cited by examiner

TECHNIQUE AND APPARATUS TO DEPLOY A PERFORATING GUN AND SAND SCREEN IN A WELL

BACKGROUND

The invention generally relates to a technique and apparatus to deploy a perforating gun and a sand screen in a well.

A conventional technique to complete a particular interval of a well may include running a perforating gun downhole to perforate the interval. After the perforating is complete, the perforating gun may be disposed by repositioning the gun away from the perforated interval; retrieving the gun to the surface of the well; or dropping the gun in a rathole, which is not an option in a horizontal wellbore. The perforating typically is then followed by sand screen deployment and gravel packing in the interval.

In this regard, a typical well may produce particulates called "sand," and therefore, a filtering substrate called "gravel" typically is used in the well to filter sand from the produced well fluid. In a gravel packing operation, the gravel is introduced in an annular region between the exterior of a sand screen and the formation. The sand screen is a tubular and porous member that is typically deployed in the well to support the gravel substrate and provide an inner space to receive the filtered well fluid, which is communicated to the surface of the well via a production tubing string. The perforating, sand screen deployment and gravel packing operations conventionally require multiple runs, or trips, into the well.

Each trip into a well involves considerable cost and time. Thus, there exists a continuing need to minimize the number of trips into a well for purposes of completing the well.

SUMMARY

In accordance with an embodiment of the invention, a technique that is usable with a well includes in a single trip into the well, perforating the well and installing a sand screen in the well.

In another embodiment of the invention, a system that is usable with a well includes a tubular body, at least one perforating charge that is disposed on the tubular body and at least one screen section that is disposed on the tubular body. The perforating charge(s) and the screen section(s) are adapted to be run downhole in a single trip into the well with the tubular body.

Advantages and other features of the invention will become apparent from the following description, drawing and claims.

DETAILED DESCRIPTION

Figure 1:
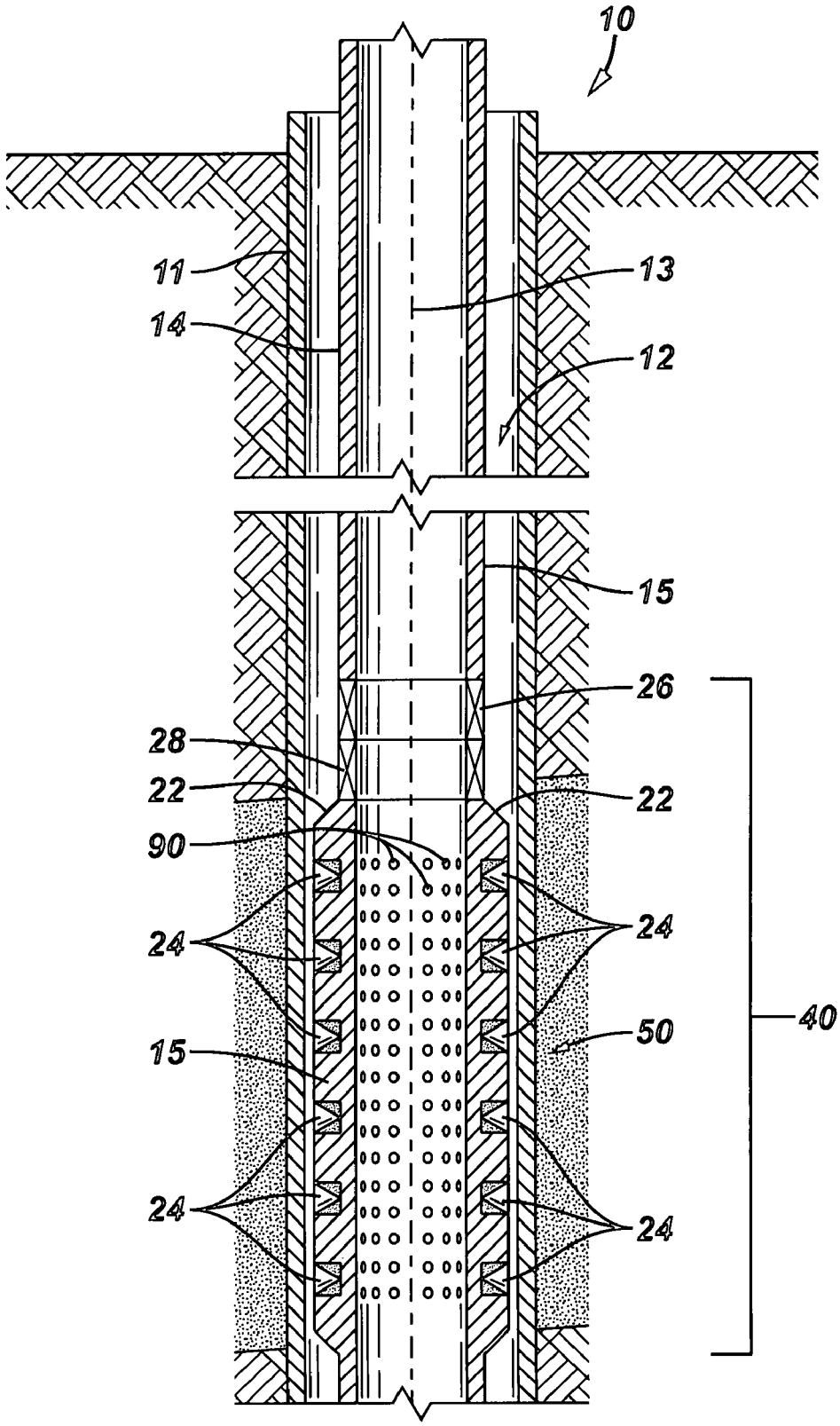
FIG. 1 is a schematic diagram of a perforating and sand screen assembly according to an embodiment of the invention.

Referring to FIG. 1, in accordance with an embodiment of the invention, a perforating and sand screen assembly 40 (herein called the "assembly 40") is deployed in a well 10 for purposes of perforating and installing a sand screen in the well 10 in a single downhole trip. In accordance with some embodiments of the invention, the assembly 40 is part of a tubular string 14 that is lowered downhole inside a borehole 12 for purposes of completing a particular interval of the borehole 12. In some embodiments of the invention, the string 14 may be formed from jointed tubing sections, and in other embodiments of the invention, the string 14 may be formed at least in part by coiled tubing. In yet other embodiments of the invention, another conveyance mechanism (such as a wireline or a slickline, as examples) may be used to deploy the assembly 40 possible in the various possible embodiments of the invention.

As depicted in FIG. 1, in accordance with some embodiments of the invention, the borehole 12 may be lined by a casing string 11. However, the systems and techniques that are disclosed herein may be likewise applied to an uncased borehole, in other embodiments of the invention. For embodiments of the invention in which the borehole is uncased, the assembly 40 may serve as a casing for the borehole. Additionally, although FIG. 1 depicts a vertical borehole 12, it is noted that the systems and techniques that are disclosed herein may likewise be used in horizontal and lateral wellbores.

In accordance with some embodiments of the invention, the assembly 40 includes a perforating gun that includes perforating charges 24 (shaped charges, for example) that are oriented to, when fired, pierce the casing string 11 and form perforating tunnels into the surrounding formation. In accordance with some embodiments of the invention, the perforating charges 24 are disposed in longitudinal fins 22 of the assembly 40. The fins 22 are parallel to a longitudinal axis 13 of the assembly 40, and each fin 22 extends radially away from a generally cylindrical inner tubular body 15 of the assembly 40. In some embodiments of the invention, the fins 22 have a uniform angular phasing about the longitudinal axis 13. For example, in accordance with some embodiments of the invention, the assembly 40 may include four fins 22 that are spaced apart by ninety degrees about the longitudinal axis 13.

Other fin orientations are possible, in other embodiments of the invention. For example, in other embodiments of the invention, each fin 22 may extend in a spiral, or helical, pattern about the longitudinal axis 13 around the exterior surface of the inner tubular body 15. Furthermore, in some embodiments of the invention, the fins 22 may have a non-uniform angular phasing about the longitudinal axis 13. For example, in accordance with some embodiments of the invention, the arrangement of the fins 22 may be generally eccentric with respect to the longitudinal axis 13 such that the fins 22 are distributed around a particular arc (less than 360°) around the longitudinal axis 13 to target a particular desired perforating angle. Additionally, in some embodiments of the invention, the assembly 40 may have more or less than four fins 22. Thus, many fin orientations, fin phasing angles and fin numbers are possible and are within the scope of the appended claims.

Figure 2:
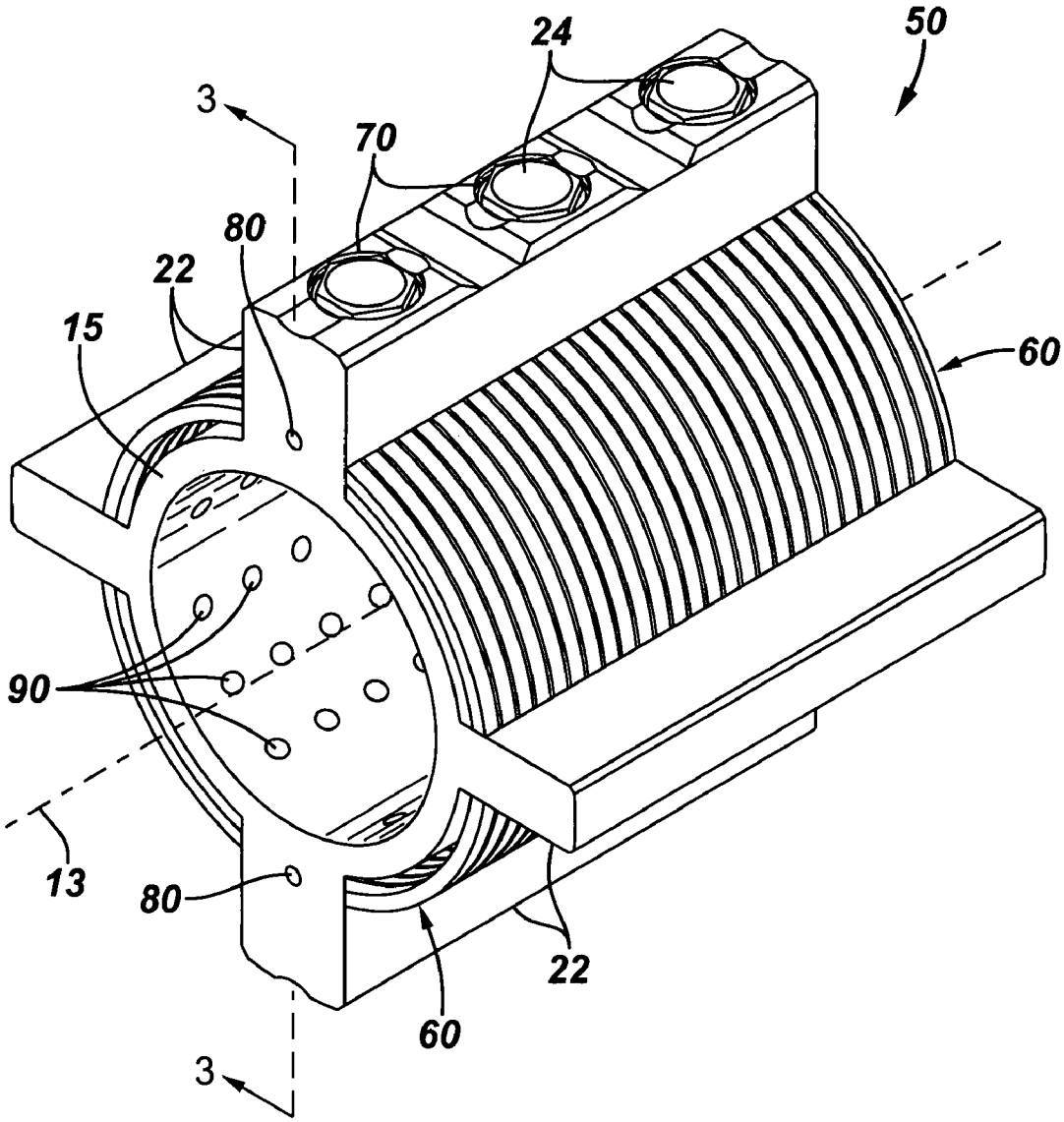
FIG. 2 is a perspective view of an exemplary section of the perforating gun and sand screen assembly according to an embodiment of the invention.

Referring to FIG. 1, in conjunction with FIG. 2, (that depicts a perspective view of an exemplary section 50 (FIG. 1) of the assembly 40), in addition to the above-described perforating gun, the assembly 40 also includes a sand screen that is deployed in sections around the tubular body 15 and longitudinal axis 13, in some embodiments of the invention. More specifically, in accordance with some embodiments of the invention, the assembly 40 includes sand screen sections 60 (see FIG. 2) that are attached to the exterior surface of the tubular member 15 and are deployed about the longitudinal axis 13 such that each sand screen section 60 is located between two of the fins 22. Thus, the fins 22 effectively form longitudinal breaks in an otherwise cylindrical sand screen that is attached to and circumscribes the tubular body 15. Due to the radial extension of the fins 22 beyond the radial extension of the sand screen, the fins 22 protect the sand screen sections 60 and form pockets to receive gravel (not shown), which serves as a filtering substrate for well fluid that is produced from the formation. For purposes of establishing fluid communication through the sand screens into the tubular body 15, the tubular body 15 includes sets of radial openings 90 that are located radially inside each sand screen section 60. Thus, FIGS. 1 and 2 each depict partial views of two such sets of openings 90 that correspond to two sand screen sections 60.

Referring to FIG. 1, among the other features of the assembly 40, in accordance with some embodiments of the invention, the perforating gun of the assembly 40 includes a firing head 26 and a ballistic junction 28. The firing head 26 may be, for example, a hydraulic firing head, that may be run into the well as part of a stand alone configuration or part of a redundant firing head configuration. Furthermore, in some embodiments of the invention, the firing head 26 may be an inductive coupler firing head, a head that is activated by pressure that is communicated through the string 14.

Alternatively, in some embodiments of the invention, the firing head 26 may be an annular inductive coupler-type firing head that is mounted on the outside of the string 14. In this regard, a male coil may be run inside the casing string 11 to the level of the firing head 26 on an electric wire line so that the male coil may be powered up through the electric wire line to fire the perforating charges 24. The male coil may also be powered up to start a delay in the firing head 26, for the scenario in which the firing head 26 is a hydraulic delay firing head. The delay permits the male coil and the electric wire line to be removed from the well before the perforating charges 24 fire. Alternatively, the male coil may be run on coiled tubing or a slickline and may be battery-powered. In other embodiments of the invention, the firing head 26 may be controlled via a wired connection (an electrical or optical cable, for example) with the surface of the well, and in yet other embodiments of the invention, the firing head 26 may be controlled via wireless stimuli (acoustic stimuli, electromagnetic stimuli, fluid pulses, stimuli communicated through a pressure tube extending to surface (e.g., a control line), as just a few examples). Thus, many variations are possible and are within the scope of the appended claims.

The ballistic junction 28, as further described below, communicates a detonation wave 360° around the longitudinal axis 13 to fire the perforating charges 24.

Referring to FIG. 2, each perforating charge 24 may be disposed in a corresponding pocket 70 of an associated fin 22. Although FIG. 2 depicts a regular spacing of the perforating charges 24 in each longitudinal fin 22, it is noted that other spacing may be used in other embodiments of the invention. As shown in the exemplary embodiment of FIG. 2, each sand screen section 60 is curved, partially circumscribes the longitudinal axis 13 and extends between two of the fins 22. When deployed in the well, well fluid may be communicated through each sand screen section 60 and through the tubular body 15 via the corresponding set of openings 90.

For purposes of communicating detonation waves to fire the perforating charges 24, the assembly 40 includes a longitudinal passageway 80 that extends through each fin 22. In this regard, the passageway 80 extends radially next to the perforating charges 24 for purposes of communicating a detonation wave to the perforating charges 24 to fire the charges 24.

Figure 3:
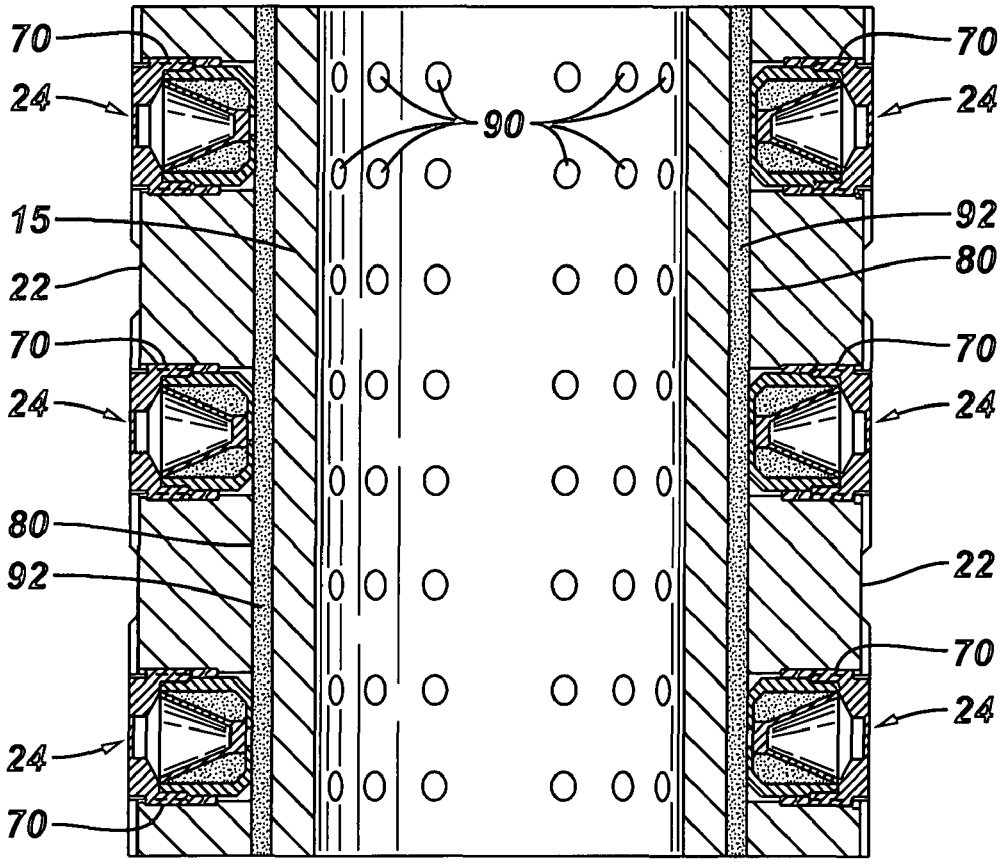
FIG. 3 is a cross-sectional view taken along line 3-3 of FIG. 2 according to an embodiment of the invention.

FIG. 3 depicts a cross-section view of the exemplary section 50, taken along line 3-3 of FIG. 2. As shown in FIG. 3, detonating cords 92 longitudinally extend along the passageways 80 for purposes of communicating a detonating wave to the perforating charges 24.

Figure 4:
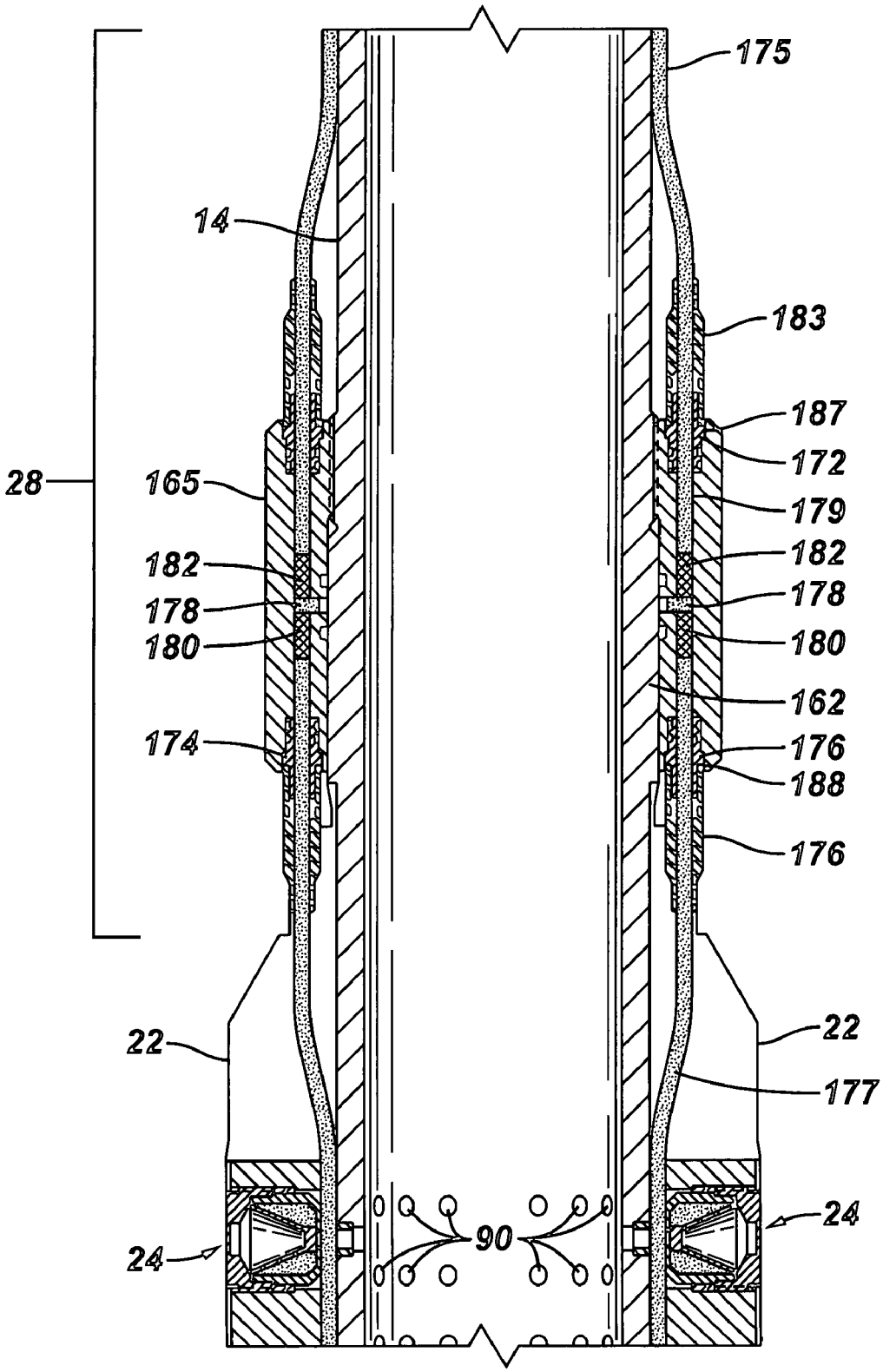
FIG. 4 is a schematic diagram of a ballistic junction according to an embodiment of the invention.

FIG. 4 depicts an embodiment of the ballistic junction 28 in accordance with an embodiment of the invention.

The ballistic junction 28 includes a collar 165 that is attached (via threads or welds, for example) to a section 162 of the string 14. The section 162 may be the lower end of another combined perforating and sand screen assembly (similar in design to the assembly 40); and thus, ballistic junctions 28 may be used to connect assemblies 40 together to form longer perforating guns and sand screens in some embodiments of the invention.

The ballistic junction 28 has the following structure for each detonating cord pair (an exemplary upper detonating cord 175 and an exemplary lower detonating cord 177 which extends to the perforating charges 24 in one of the fins, as depicted in FIG. 4) that is longitudinally coupled through the junction 28. The structure includes an upper opening 187 in the collar 165 and a lower opening 188 in the collar 165. A longitudinal passageway 179 of the collar 165 extends between the lower 188 and upper 187 openings. The lower opening 188 receives a hydraulic seal fitting nut 174, which receives and secures the lower detonating cord 177 to the collar 165; and an elastomeric seal boot 176 covers the connection between the lower detonating cord 177 and the nut 174. Likewise, the upper opening 187 receives a hydraulic seal fitting nut 172, which receives and secures the upper detonating cord 175 to the collar 165; and an elastomeric seal boot 183 covers the connection between the upper detonating cord 175 and the nut 172.

Inside the longitudinal passageway 179, the upper end of the lower detonating cord 177 is connected to a lower detonator 180, and the lower end of the upper detonating cord 175 is connected to an upper detonator 182. One or more detonating cords 178 circumferentially extend (in a circumferential passageway in the collar 165) 360° about the longitudinal axis of the junction 28 to ballistically couple the detonating cord pairs together. Due to this arrangement, the detonating cord (s) 178 serve as redundant detonating cord(s) to ensure that an incoming detonation received on one side of the ballistic junction 28 is relayed to all detonating cords on the other side of the ballistic junction 28.

The ballistic junction 28 that is depicted in FIG. 4 is one out of many possible embodiments of ballistic junctions in accordance with the various embodiments of the invention. For example, the ballistic junction may be replaced by another ballistic junction, such as the one described in U.S. patent application Ser. No. 10/686,043, entitled, "TECHNIQUES AND SYSTEMS ASSOCIATED WITH PERFORATION AND THE INSTALLATION OF DOWNHOLE TOOLS," filed on Oct. 13, 2003, and U.S. patent application Ser. No. 10/908,037, entitled, "TECHNIQUE AND APPARATUS FOR MULTIPLE ZONE PERFORATING," filed on Apr. 26, 2005, which are hereby incorporated by reference in their entirety.

Figure 5:
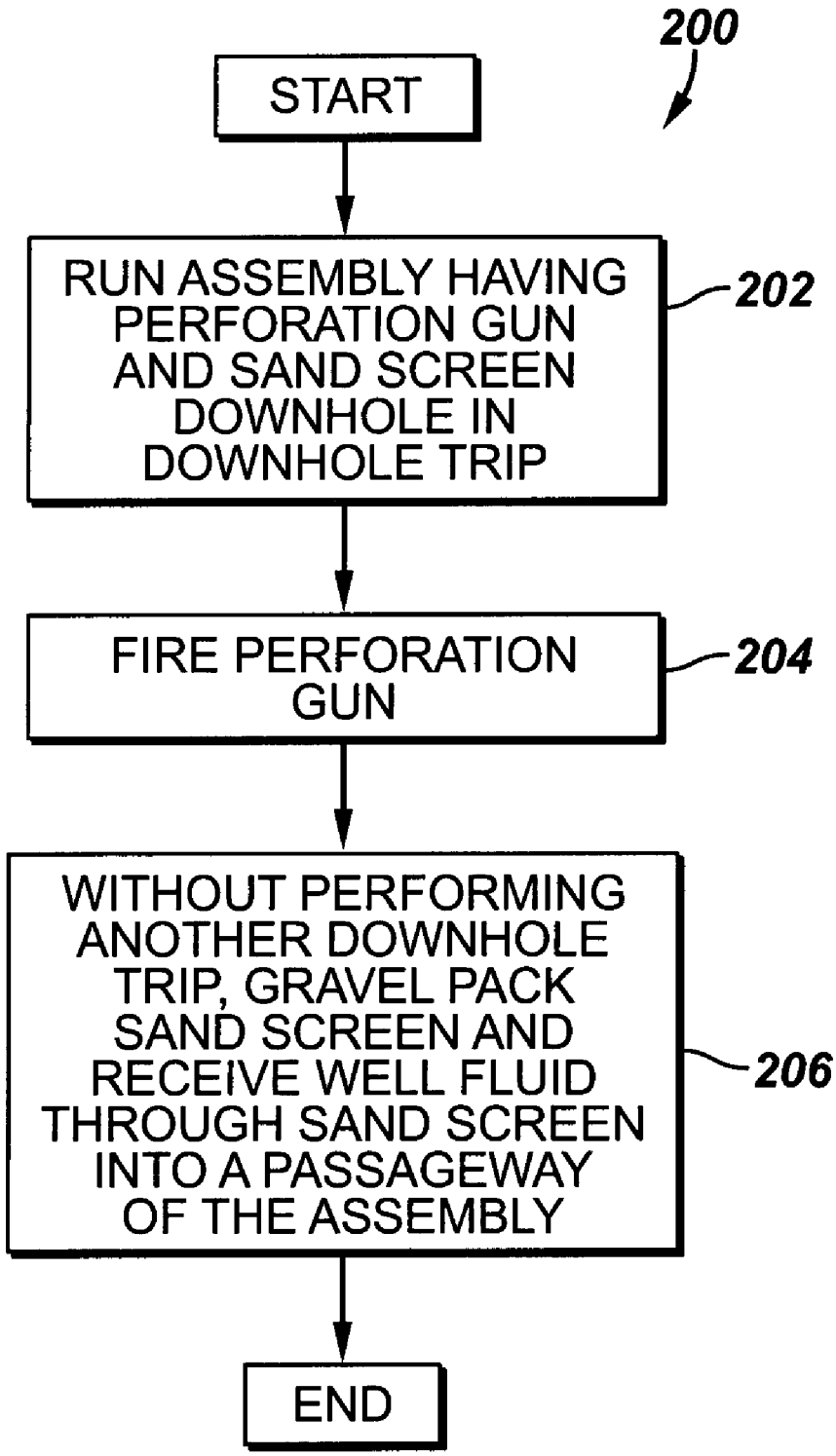
FIG. 5 is a flow diagram depicting a technique to deploy a perforating gun and a sand screen downhole according to an embodiment of the invention.

Referring to FIG. 5, to summarize, a perforating gun and sand screen deployment technique 200 in accordance with embodiments of the invention includes running (block 202) an assembly that has an integrated perforating gun and sand screen downhole in a single downhole trip. The technique 200 includes firing (block 204) the perforating gun of the assembly, and without performing another downhole trip, the sand screen is gravel packed so that the assembly may receive well fluid through the sand screen into a passageway of the assembly, as depicted in block 206. The firing of the perforating charges 24 may be performed in connection with underbalanced perforating, in some embodiments of the invention.

While the present invention has been described with respect to a limited number of embodiments, those skilled in the art, having the benefit of this disclosure, will appreciate numerous modifications and variations therefrom. It is intended that the appended claims cover all such modifications and variations as fall within the true spirit and scope of this present invention.

What is claimed is:

1. A method usable with a well, comprising:

in a single trip into the well, perforating the well and installing a sand screen in the well, comprising running an assembly comprising a tubular member and the sand screen into the well;

providing fins on the assembly, each of the fins comprising a continuous segment that longitudinally extends along a longitudinal axis of the tubular member and radially extends away from the tubular member by a substantially constant radial offset along the entire length of the segment;

disposing perforating charges in pockets formed in a distal end of at least one of the fins such that the segment of each fin having pockets formed therein contains multiple perforating charges; and circumferentially disposing the sand screen in separate segments about a longitudinal axis of the assembly, each segment circumferentially extending about the longitudinal axis between two of the fins.

2. The method of claim 1, further comprising:

using the fin to protect at least part of the sand screen.

3. The method of claim 1, wherein the perforating and installing comprises running the assembly inside a casing string.

4. The method of claim 1, wherein the perforating comprises underbalanced perforating.

5. The method of claim 1, wherein the perforating and installing comprises:

firing the perforating charges, and subsequently gravel packing near the sand screen.

6. The method of claim 1, further comprising:

extending a detonating cord around a longitudinal axis of a perforating gun to transfer charges to multiple sets of perforating charges of the perforating gun.

7. The method of claim 1, further comprising:

radially extending the fins beyond the separated segments to form pockets to receive a gravel packing substrate.

8. The method of claim 1, wherein the segment of each fin includes pockets formed therein to receive the perforating charges.

9. The method of claim 1, further comprising:

exposing the perforating charges to a downhole environment prior to the firing of the perforating charges.

10. The method of claim 9, wherein the perforating charges comprise encapsulated shaped charges, each of the encapsulated shaped charges having an associated charge cap having an outer surface, and the exposing comprises exposing the outer surface of each encapsulated shaped charge to the downhole environment.

11. The method of claim 9, further comprising:

exposing the sandscreen to the downhole environment prior to the firing of the perforating charges.

12. The method of claim 1, further comprising:

installing the assembly in a casing.

13. A system usable with a well, comprising:

a tubular body;

fins, each fin comprising a continuous segment to longitudinally extend along the longitudinal axis of the tubular body and radially extend away from the tubular body by a substantially constant radial offset along the entire length of the segment;

a plurality of pockets formed in a distal end of at least one of the fins along the longitudinal axis thereof;

perforating charges disposed in the plurality of pockets of the fins, such that each segment of each fin having pockets formed therein contains multiple perforating charges; and a sand screen attached to the tubular body and circumferentially disposed about the longitudinal axis, the sand screen comprising separate segments and each of the segments circumferentially extending about the longitudinal axis between two of the fins, wherein the perforating charges and the sand screen are adapted to be run downhole in a single trip into the well with the tubular body.

14. The system of claim 13, wherein the tubular body comprises openings to establish fluid communication between the sand screen and a passageway of the tubular body.

15. The system of claim 13, wherein the perforating charges are disposed in pockets in the fins.

16. The system of claim 13, wherein the fin is adapted to protect the sand screen.

17. The system of claim 13, further comprising:

a ballistic junction to communicate a detonation wave around a longitudinal axis of a perforating gun to transfer charges to the multiple perforating charges.

18. The system of claim 13, wherein the fins extend radially beyond the separate segments to form pockets to receive gravel packing subs.

19. The system of claim 13, wherein the segment of each fin includes pockets formed therein to receive the perforating charges.

20. The system of claim 13, wherein the perforating charges, sand screen and fins are exposed to the same downhole environment prior to the firing of the perforating charges.

21. The system of claim 20, wherein the perforating charges comprise encapsulated shaped charges, each of the encapsulated shaped charges having an associated charge cap having an outer surface, and the outer surface of each encapsulated shaped charge is exposed to the downhole environment prior to the firing of the perforating charges.

22. The system of claim 13, further comprising:

a casing, wherein the fins, the perforating charges, the sand screen and the tubular body are adapted to form an assembly be disposed downhole inside the casing.

* * * * *